US010443898B2

(12) United States Patent
Keshavan Raghavan

(10) Patent No.: US 10,443,898 B2
(45) Date of Patent: Oct. 15, 2019

(54) AIR COMPRESSOR SYSTEM INCLUDING A REFRIGERATED DRYER AND A CONDENSATE HARVESTER AND WATER SUPPLY

(71) Applicant: Ingersoll-Rand Company, Davidson, NC (US)

(72) Inventor: Mahesh Kumar Keshavan Raghavan, Ahmedabad (IN)

(73) Assignee: Ingersoll-Rand Company, Davidson, NC (US)

( * ) Notice: Subject to any disclaimer, the term of this patent is extended or adjusted under 35 U.S.C. 154(b) by 293 days.

(21) Appl. No.: 15/337,634

(22) Filed: Oct. 28, 2016

(65) Prior Publication Data

US 2018/0119995 A1 May 3, 2018

(51) Int. Cl.

| | |
|---|---|
| ***F25B 1/00*** | (2006.01) |
| ***F04B 37/20*** | (2006.01) |
| ***F04B 39/16*** | (2006.01) |
| ***F04B 41/02*** | (2006.01) |
| *F04C 29/00* | (2006.01) |
| *F04D 29/70* | (2006.01) |

(52) U.S. Cl.

CPC ..... *F25B 1/00* (2013.01); *F04B 37/20* (2013.01); *F04B 39/16* (2013.01); *F04B 41/02* (2013.01); *F04C 29/0092* (2013.01); *F04D 29/706* (2013.01); *F25B 2600/0261* (2013.01)

(58) Field of Classification Search

CPC ..... F24F 3/1405; F24F 13/22; F24F 13/222; F24F 2013/227; F24F 2003/144; F24F 2003/1446

USPC ..... 62/150

See application file for complete search history.

(56) References Cited

U.S. PATENT DOCUMENTS

| | | | | |
|---|---|---|---|---|
| 2,875,593 A | | 3/1959 | Kice et al. | |
| 3,812,687 A | | 5/1974 | Stolz | |
| 4,266,406 A | | 5/1981 | Ellis | |
| 4,272,025 A | * | 6/1981 | Mazzotti | B05B 3/0427 239/240 |
| 5,327,743 A | | 7/1994 | Coltrin | |
| 5,699,673 A | * | 12/1997 | Hoshino | B01D 53/265 62/272 |
| 5,979,172 A | | 11/1999 | Teller | |
| 6,067,812 A | | 5/2000 | Bushnell et al. | |

(Continued)

FOREIGN PATENT DOCUMENTS

JP WO 2005026625 A1 * 3/2005 ..... F24D 17/02

*Primary Examiner* — Jonathan Bradford

(74) *Attorney, Agent, or Firm* — Taft Stettinius & Hollister LLP

(57) ABSTRACT

An air compressor system useful for supplying a stream of compressed air for an end user is disclosed which includes a refrigerated dryer useful to remove moisture and harvest it from the compressed air. The refrigerated dryer includes an evaporator and a condenser, where the evaporator is useful to produce the moisture from the compressed air. The air compressor system includes an expansion tank which collects the harvested moisture from the evaporator and a supply line from a utility water supply, both of which can be used to provide liquid to a condenser of the dryer. A valve is used to bring together either or both of the condensate from the expansion tank and water from the utility water supply. The valve includes an outlet that provides liquid to a condenser of the dryer.

21 Claims, 4 Drawing Sheets

(56) References Cited

U.S. PATENT DOCUMENTS

| | | | | |
|---|---|---|---|---|
| 6,244,576 | B1 * | 6/2001 | Tsai | F24F 6/02 261/141 |
| 6,857,285 | B2 | 2/2005 | Hebert | |
| 6,912,859 | B2 | 7/2005 | Klein | |
| 7,013,658 | B2 | 3/2006 | Dobmeier et al. | |
| 7,441,412 | B2 * | 10/2008 | Jensen | F24F 1/06 261/27 |
| 8,408,022 | B2 | 4/2013 | Stockton, Jr. | |
| 8,490,422 | B2 | 7/2013 | Al Watban | |
| 2010/0083674 | A1 | 4/2010 | Merritt | |
| 2011/0232313 | A1 | 9/2011 | Chillar et al. | |
| 2013/0200536 | A1 * | 8/2013 | Seremetis | F24F 6/12 261/70 |
| 2013/0333405 | A1 | 12/2013 | Belady et al. | |
| 2015/0354849 | A1 * | 12/2015 | Matsuo | F28F 27/00 62/79 |

* cited by examiner

AIR COMPRESSOR SYSTEM INCLUDING A REFRIGERATED DRYER AND A CONDENSATE HARVESTER AND WATER SUPPLY

TECHNICAL FIELD

The present invention generally relates to air compressor systems having a refrigerated dryer, and more particularly, but not exclusively, to harvesting condensate from a compressed air stream of the air compressor system using the refrigerated dryer.

BACKGROUND

Providing condensate harvesting for air compressor systems remains an area of interest. Some existing systems have various shortcomings relative to certain applications. Accordingly, there remains a need for further contributions in this area of technology.

SUMMARY

One embodiment of the present invention is a unique condensate harvester used with a refrigerated dryer for a compressor system. Other embodiments include apparatuses, systems, devices, hardware, methods, and combinations for harvesting condensate. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
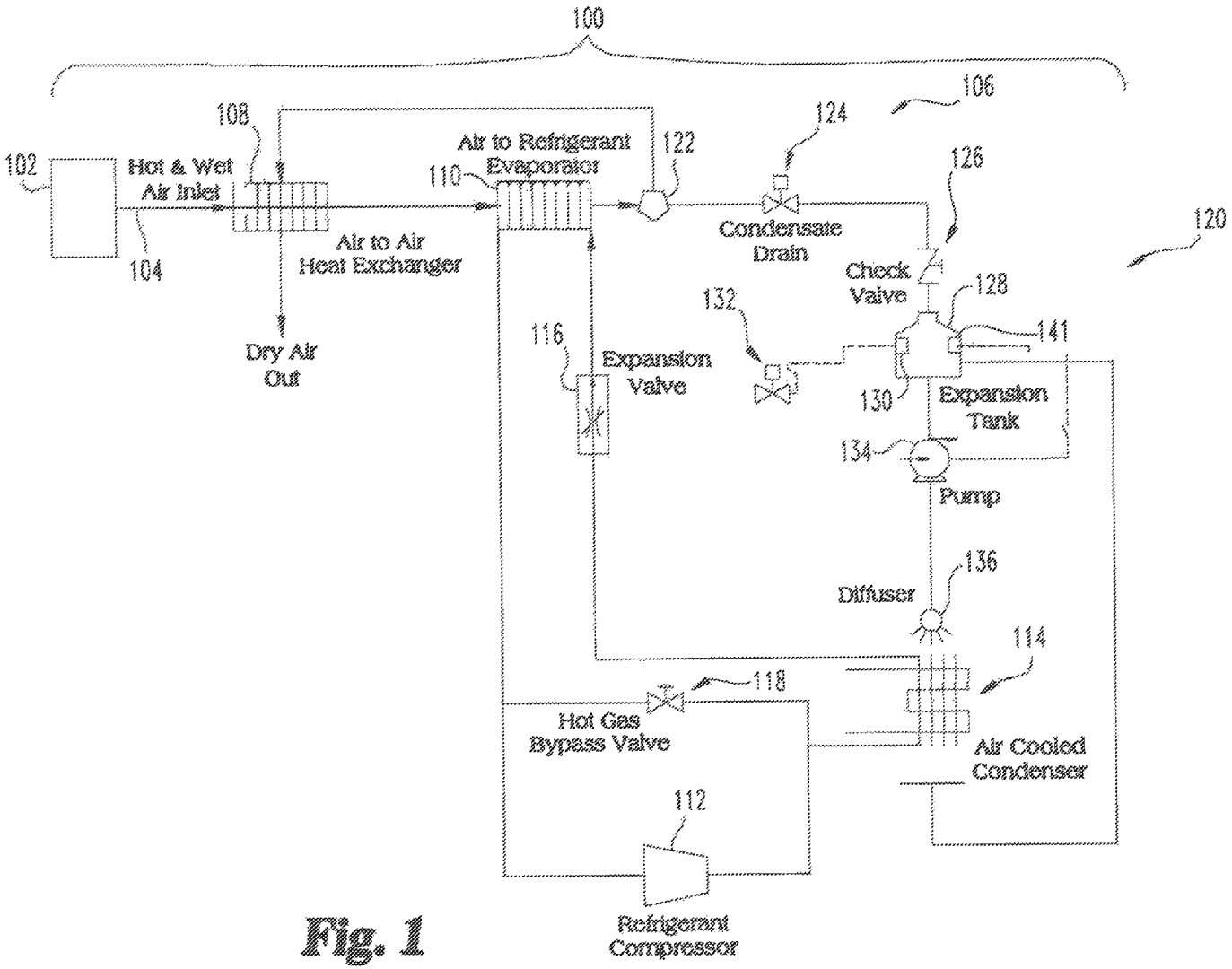
FIG. 1 depicts an embodiment of a compressor system that includes a dryer and condensate harvester.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, an embodiment is illustrated of a compressor system 100 that includes a gas compressor 102 capable of producing a compressed gas stream 104 and a refrigerated dryer 106 useful for removing water vapor from the compressed gas stream 104 prior to providing the dried gas stream to an end user/facility compressed air system/etc.

The gas compressor 102 can take many forms including a positive displacement compressor, rotary compressor, etc. Any variety of gas compressors 102 are contemplated herein, such as rotary screw compressors, centrifugal compressors, etc. The compressor 102 is capable of compressing any variety of fluids, with air being just one nonlimiting example. In one form the air that is compressed by compressor 102 includes water vapor, such as might be expected to occur in elevated humidity locations.

The compressor system 100 can include an air to air heat exchanger 108 used to exchange air between an uncooled compressed air stream from the compressor 102, and the compressed air stream from the compressor 102 after it has been cooled by the refrigerated dryer 106. Not all embodiments need include the air to air heat exchanger 108. In those embodiments, compressed air from the compressor 102 can be passed to the refrigerated dryer 106 and then direct to an end user.

The refrigerated dryer 106 includes an evaporator 110, refrigerant compressor 112, and a condenser 114. The refrigerated dryer 106 can also include an expansion valve 116 and a hot gas bypass valve 118. The expansion valve 116 is used to rapidly expand (and thus cool) refrigerant and can be part of the evaporator in some embodiments, but not all embodiments need include the expansion valve 116. Not all embodiments of the refrigerated dryer need include the hot gas bypass valve 118.

The evaporator 110 can be any suitable device operable to absorb heat from a surrounding component/fluid, etc. As suggested above, the evaporator 110 can integrate the expansion valve 116 and in general is structured as a heat exchanger to exchange heat between a cooled refrigeration fluid and a passing flow stream (such as the wet compressed air flow stream produced by operation of the compressor 102). Various constructions of the evaporator 110 are contemplated in which refrigeration fluid is in thermal communication with the wet compressed gas. For example, the evaporator 110 can include a surface that is directly contacted by the passing flow stream of wet compressed gas such that thermal energy is exchanged directly between the refrigeration fluid and the wet compressed gas. But in other forms the evaporator 110 can be structured to include intermediate thermally conductive structure between the evaporator 110 and the wet compressed gas such that thermal energy is exchanged via the intermediate structure. In either event, the evaporator 110 is used to elevate the temperature of the refrigeration fluid while cooling the temperature of the wet compressed gas.

The refrigerant compressor 112 is any suitable compressor that can elevate the pressure of refrigeration fluid for purposes of flowing the fluid through and participating in the refrigeration cycle. Any suitable type of compressor is contemplated that is capable of producing sufficient pressure and flow rate of refrigeration fluid in the cycle. As used herein, and unless indicated to the contrary, use of the term compressor is intended to cover all devices that serve to elevate the pressure of the refrigeration fluid and provide a motive force to encourage flow of the refrigeration fluid throughout the closed cycle of the refrigerated dryer The condenser 114 is any suitable device capable of cooling the refrigeration fluid in the refrigerated dryer 106. In one non-limiting form the condenser 114 is an air cooled condenser in which local ambient air, or a flow stream of local ambient air, is used to exchange heat with the high temperature refrigeration fluid flowing through the condenser 114.

The compressor system 100 further includes a condensate harvester 120 for collecting condensate produced as a consequence of operation of the refrigerated dryer 106, and providing that condensate to the condenser 114 of the refrigerated dryer 106. The condensate harvester 120 includes a condensate collector 122 structured to direct liquid condensate away from the evaporator 110, a condensate drain 124 and check valve 126 (not required in all embodiments), and an expansion tank 128 useful for depositing and storage of condensate collected from operation of the evaporator 110.

The expansion tank 128 can take on a variety of forms. In one non-limiting example, the expansion tank 128 can be a closed vessel having a venting/breather feature (to permit the vessel to breathe and accept volumetric changes in liquid level with minimal disruptions in internal gas pressurization. Such a breather/vent can take any variety of forms well known and can include a filter to minimize intrusion of foreign debris into the expansion tank 128. In other embodiments the tank 128 can take on the form of an open top container.

The condensate harvester 120 also includes provisions to provide the collected condensate to the condenser 114. A pump 134 and diffuser 136 are in fluid communication with liquid from the expansion tank 128. The pump 134 can be any device suitable to convey liquid from the expansion tank 128 to the condenser 114, such as a positive displacement pump, diaphragm pump, rotary pump, etc. The pump 134 can be a single speed pump in some embodiments in which case it can be cycled on and off as needed, but in other forms can be a multi-speed pump. Such multi-speed pump can be a pump that operates at a variety of pump speeds, whether continuously variable or pre-set speeds.

The diffuser 136 is any suitable device either integrated with or in fluid communication with the pump 134 sufficient to disperse the liquid provided from the pump 134 to the condenser 114. Such a diffuser 136 can include a spray head that disperses the passing liquid into separate streams or droplets sufficient to provide some amount of cooling to the condenser 114 to assist in heat rejection from the refrigerant in the condenser 114.

In operation of the compressor system 100, when the wet compressed gas from the compressor 102 is provided to the evaporator 110, condensation can be formed when the wet compressed gas is cooled below its dew point. Such condensation can take the form of water liquid when the gas to be compressed is a mixture of air and water vapor, to set forth just one non-limiting example. The condensation can also take the form of solid water in those instances where the temperature of the evaporator during use falls below a freezing point of the gas composition which is to be extracted from the compressed gas (e.g. water vapor in the case of air and water mixture). Condensation received by the collector 122 can be provided to the expansion tank 128 where it can either accumulate over time and/or be used to cool the condenser 114.

The compressor system 100 depicted in FIG. 1 includes a high condensate level sensor 130 which is used to detect a fluid level within the expansion tank 128 that reaches a pre-determined high level mark. In some embodiments the pre-determined high level mark is a maximum capacity of the tank 128, or some other safety buffer located below a maximum capacity. In those embodiments in which the sensor 130 detects liquid level at a location below a top of the expansion tank, the distance can be offset to allow some amount of excess condensate to build-up, but still below a top level of the expansion tank.

A high liquid level in the tank 128 can therefore be at or below a top level of the tank 128. In those forms where the expansion tank 128 is a closed vessel (possibly also including a vent/breather), the high condensate level can occur at a level below a top of the closed vessel to prevent undesirable pressure buildup cessation of harvesting abilities, or an overflow condition. Overflow event includes an event where condensate undesirably backflows into the conduit (such as conduit that leads from the evaporator), or undesirably overflows from the top of an open container, or undesirably flows into an air vent of the expansion tank 128, etc.

When the high condensate level sensor 130 detects a liquid level that reaches the pre-determined level, a signal can be formed by operation of the sensor 130 and sent to an overflow valve 132 which is in fluid communication with the liquid in the tank 128. The valve 132 can take on a variety of forms, including electromechanical, hydraulic, pneumatic, etc. The valve 132 can include a mechanism, such as a solenoid, that is moved between an open and a closed position. The solenoid can be biased in one direction and energized to move in the other direction, to either open or close the valve 132.

Upon receipt of a signal the overflow valve 132 can be opened to release liquid from the tank 128. The overflow valve can be in fluid communication with a fluid level in the tank that corresponds to the high liquid level, but can also be located at different heights as well.

The compressor system 100 depicted in FIG. 1 can also include a low condensate level sensor 141 which is used to detect a fluid level within the expansion tank 128 in which a predetermined insufficient level of liquid is present. In some embodiments the pre-determined low level mark is a minimum capacity of the tank 128 to provide liquid to the pump for a set period of time, or some other safety buffer located below a minimum capacity. In those embodiments in which the sensor 130 detects liquid level at a location above a bottom of the expansion tank, the distance can be offset to allow some amount of condensate to be provided to the pump to permit some time to shut down the pump, but still below a bottom level of the expansion tank.

When the low condensate level sensor 141 detects a liquid level that reaches the pre-determined level, a signal can be formed by operation of the sensor 141 and sent to the pump 134. Upon receipt of a signal the pump 134 can be switched off or shut down. The pump 134 can be in fluid communication with a fluid level in the tank that corresponds to the low liquid level, but can also be located at different heights as well and in some embodiments located below a bottom of the tank 128.

The overflow valve 132 and/or the pump 134 can thus be controlled through detection of a high liquid level made possible by the high condensate level sensor 130 and a low liquid level made possible by the low condensate level sensor 141, respectively. Such a controller (either for the valve 132 or pump 134, or both) can be a direct electrical controlled connection that switches the overflow valve 132 to an open condition (or cuts power to the pump 134), or can be through an intermediate system such as an integrated circuit controller. Thus, the controller can be a programmable IC, but can also include analog components such that a control action is realized. The controller can include any combination of electronic circuitry and components such as resistors, capacitors, and semiconductor devices, among potential others. A "controller" in this sense is any type of electrical device sufficient to activate the system to release condensate from the expansion tank. For example and as suggested above, the "controller" can be a simple switch, a more complicated electrical circuit, or a programmable integrated circuit, among potential others, that activates the pump upon receipt of a voltage or current signal from the sensors, among potential others. As such, use of the term "controller" is not intended to apply exclusively to programmable IC type devices unless otherwise indicated to the contrary. It is rather intended to encompass devices/arrangements/configurations/etc that are useful to "control" the level of condensate through action of a pump, valve, etc. Furthermore, the controller can be one or many separate components that together work to provide operation of the system including opening and closing valves, regulating action of the pump, etc. The control can either be analog or digital, and in this sense any signals developed from the high condensate level sensor 130 or low condensate level sensor 141 can be sampled at set periods or can be continuously monitored.

When the valve 132 is opened by detection of a high liquid level in the tank 128, the valve 132 can stay open for any duration or event sufficient to indicate relief of water from the tank 128. For example, the valve can remain open for a pre-determined period of time such as through a digital timer regardless of whether the high condensate level sensor 130 continues to detect a high liquid level. In other forms the valve 132 can be opened for a period of time that is calculated to drain a set quantity of liquid assuming certain flow behaviors of valve type, fluid type, fluid pressures and temperature, etc.

Figure 2:
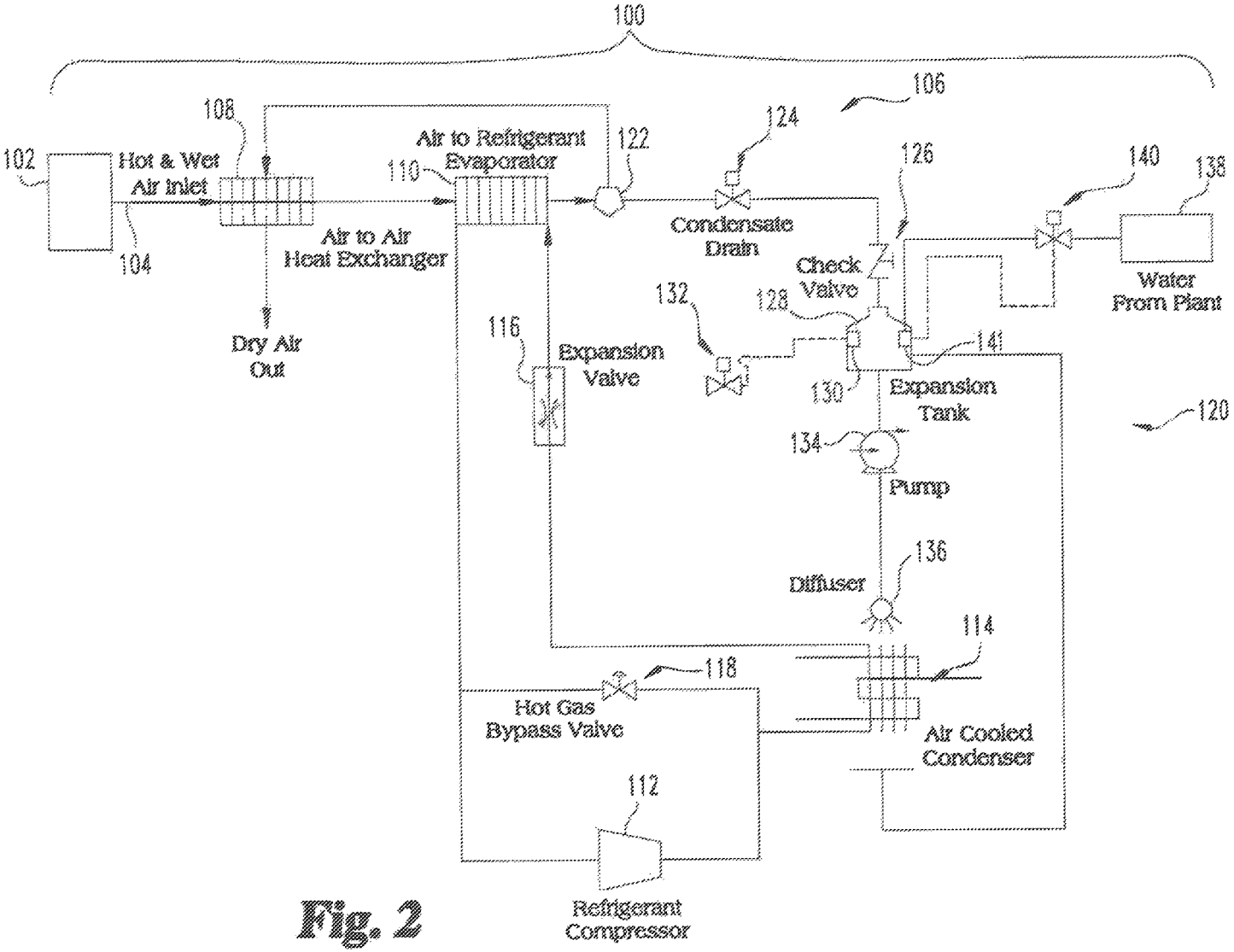
FIG. 2 depicts another embodiment of a compressor system that includes a dryer and condensate harvester.

Turning now to FIG. 2, where like reference numerals refer to like elements described elsewhere in the application, the expansion tank 128 is further connected in fluid communication with a utility water supply 138 which can be used to supplement liquid within the tank 128 harvested from condensate developed by the evaporator 110. A valve 140 can be used to open and close a conduit that provides water from the utility water supply 138.

The utility water source 138 can be a large network of pipes serviced by a water provider that pulls water from any variety of sources such as reservoirs, water towers, tanks, etc. A utility provider of water, much like an electric utility, is one example of a utility water source. The network is generally a series of interconnected conduits that are capable of servicing a wide variety of end customers, some of which can use their own filtration and intermediate tanks, reservoirs, but all of which generally remain connected through valving and other devices to the utility water source.

The condensate provided to the tank 128 formed by operation of the evaporator 110 can be condensate from whatever vapor is entrained in the compressed gas of choice (e.g. water vapor, but other vapors also possible). When utility water is supplied to the tank 128, the liquid provided to the pump 134 can be either the water from the utility water supply, liquid from the vapor that was condensed by the evaporator, or a mixture of the two depending upon the particular application.

The valve 140 can be controlled by detection of low liquid level through low condensate level sensor 141 to permit entry of water from the utility water supply 138 to enter the tank 128. The valve 140 can remain open for a set period of time such as could be implemented using a timer. A pre-determined period of time that the valve 140 is opened can be determined through water supply pressure and valve geometries, among other possibilities. Persons of skill in the art can determine quantities of fluid delivered through a valve using knowledge of upstream fluid flow properties such as pressure. The time can be determined from assumptions of pressure and a desired quantity to fill the expansion tank. Alternatively, persons of skill in the art can pick a set period of time without regard to any information pertaining to water supply pressure, valve configuration, etc. In still other forms, the valve 140 could remain open until water reaches the overflow sensor 128.

The valve 140 can take on a variety of forms, including electromechanical, hydraulic, pneumatic, etc. The valve 140 can include a mechanism, such as a solenoid, that is moved between an open and a closed position. The solenoid can be biased in one direction and energized to move in the other direction, to either open or close the valve 140.

Figure 3:
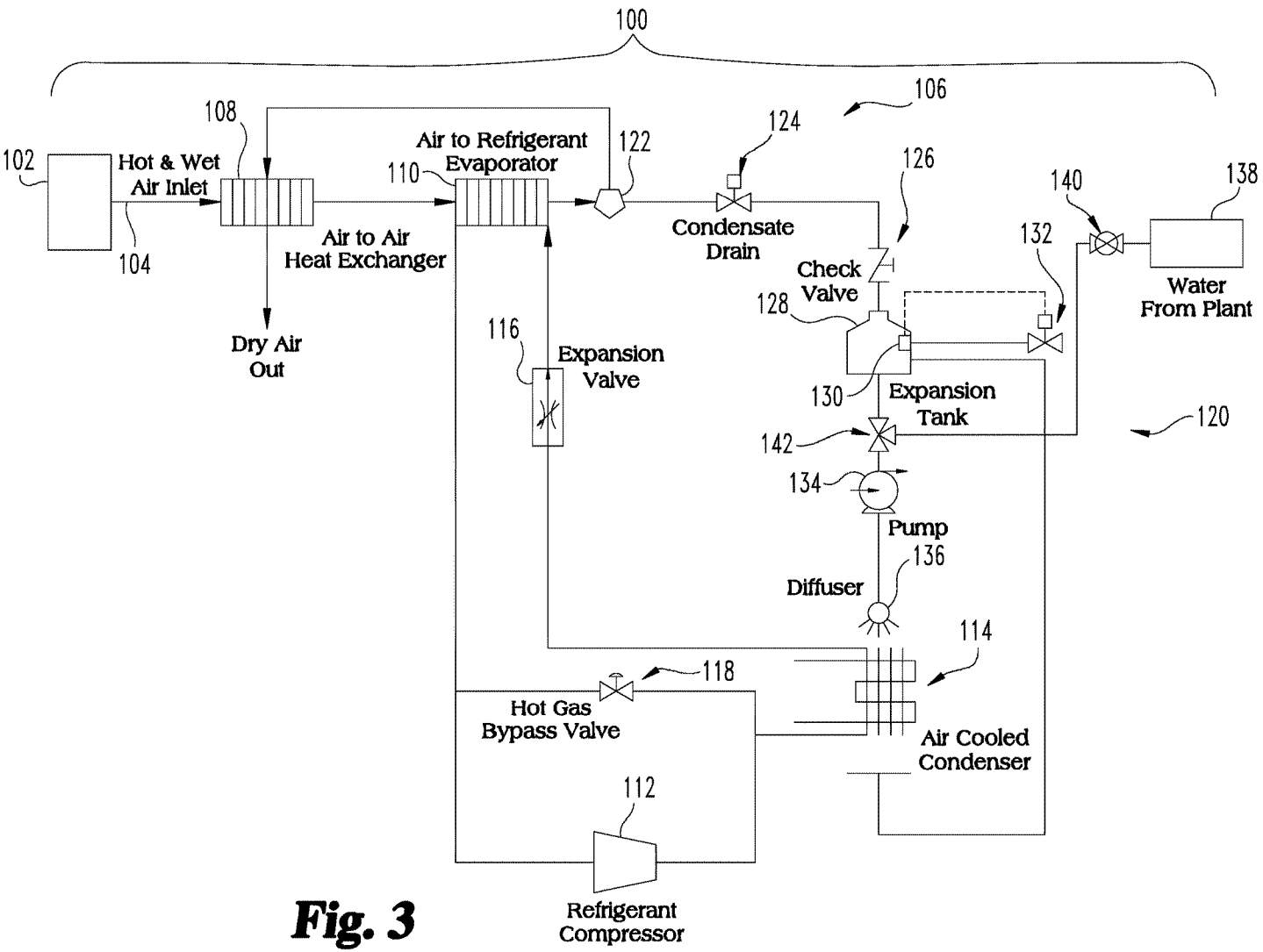
FIG. 3 depicts another embodiment of a compressor system that includes a dryer and condensate harvester.

Turning now to FIG. 3, where like reference numerals refer to like elements described elsewhere in the application, water from the utility water supply 138 can be mixed with, or replace, liquid from the expansion tank 128 through action of a valve 142. The valve 142 can be any suitable device for controlling the passage of fluid through a pipe or duct, such as a device that permits fluid flow in one direction only, a device that can select between sources, and a device that can mix streams together. The valving member can be an actuatable valve (such as an electric, pneumatic, or hydraulically driven valve) or a passive valving device such as a venture that acts to entrain one source of fluid with another. Some examples of different types: the valve 142 can be a mixing valve, 3-way valve, a 3-way thermal mixing valve, or a Venturi-type valve, among potential others.

A 3-way thermal mixing valve can be used to ensure constant temperature of fluid provided to the condenser 114. The thermal nature of the valve can help ensure or seek to achieve more or less consistent temperature in light of the fact that condensate collected from the evaporator 110 is usually at lower temperature than water from the utility water supply 138.

In another example, in case the valve 142 is of a Venturi type, the valve 142 can be a passive device that entrains, via suction action, liquid from the tank 128 using a flow of utility water. The valve 142 can include internal passages that accelerate a flow of utility water which is used a primary flow stream to encourage entrainment of a relatively low speed and higher pressure liquid from the tank 128.

The liquid in the tank 128 can be in communication with the valve 142 using any number of conduits and devices. In one form a conduit can be provided that has an opening at the bottom of the tank and a check valve disposed along the conduit between the bottom of the tank and the valve 142. The check valve can be used to discourage a flow of water from the valve 142 to the tank 128, and instead to permit a flow of liquid from the tank 128 to the valve 142 when sufficient suction pressure urges the check valve to open to permit entrainment of the liquid from the tank 128. A check valve can also be added to the line from the utility water supply 138 to discourage a flow of water from the valve 142 to the supply 138, and instead to permit a flow of liquid from the supply 138 to the valve 142 when sufficient suction pressure exists on the valve 142 side of the check valve (in addition to water pressure on the utility water supply side) urges the check valve to open to permit flow of water from the utility water supply 138.

In other embodiments, the high condensate level sensor 130 and overflow valve 130 combination can be used as indicator when to switch a 3-way valve 142 to use harvested condensate. Such an embodiment can include opening the valve 132 for a period of time less than a period of time required to completely drain the tank 128, with the residual liquid in the tank used by the pump 134 via the valve 142 for another pre-determined period of time.

In still other forms, the valve 142 in the form of a three way valve could be actuated by an embodiment of the tank 128 that includes a low condensate level sensor 130.

In still further forms, the valve 140 can be opened as soon as the compressor system 100 is activated, thus supplying water to the condenser 114 continuously and entraining condensate whenever it is collected in the tank 128.

Figure 4:
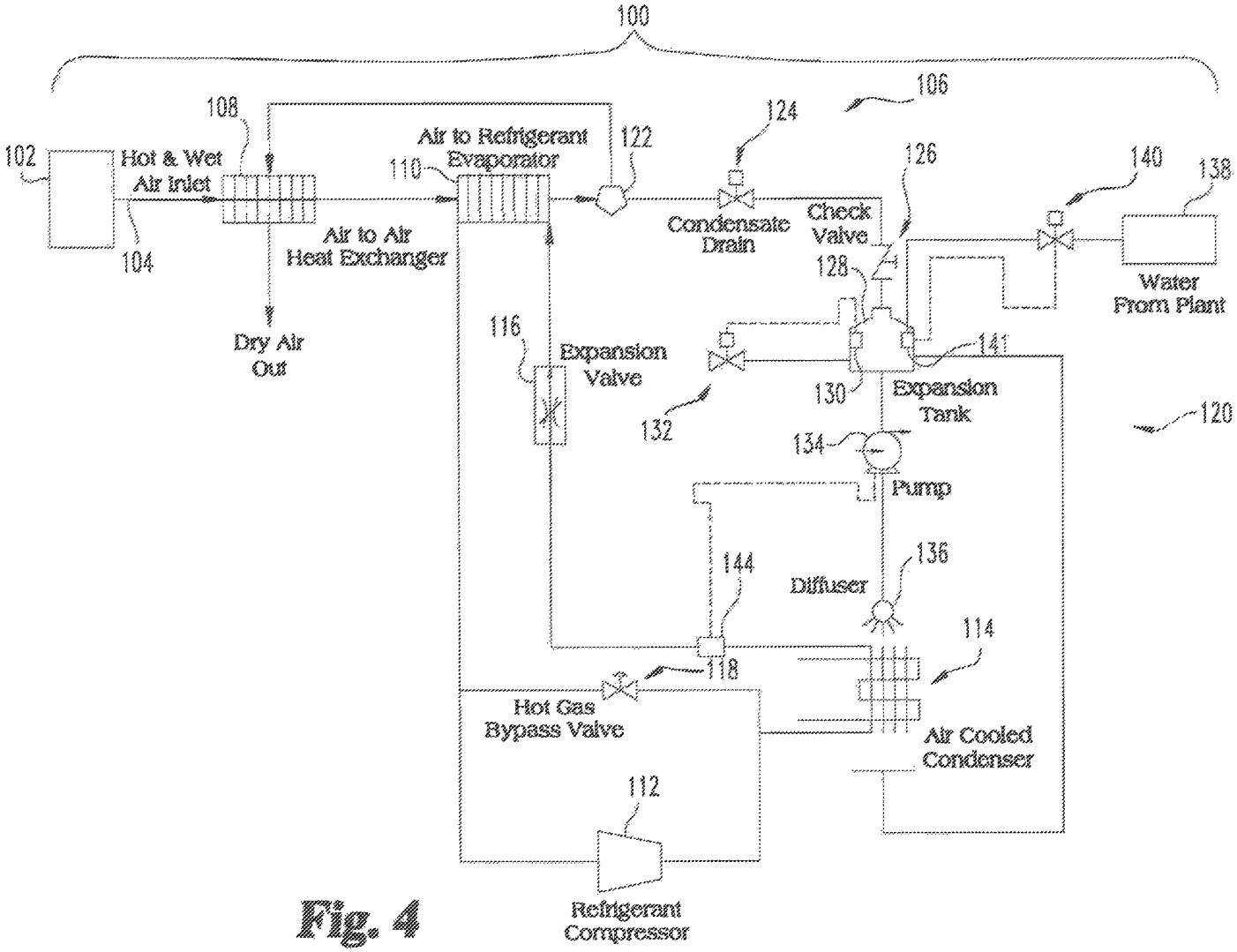
FIG. 4 depicts another embodiment of a compressor system that includes a dryer and condensate harvester.

Turning now to FIG. 4, another embodiment of the compressor system 100 includes the ability to regulate the rate of liquid delivery by the pump 134 to the condenser 114 depending on a temperature related to operation of the condenser 114. The compressor system 100 can include a temperature sensor 144 structured to detect a temperature related to operation of the condenser 114. At a pre-determined temperature, the temperature sensor 144 can provide a signal useful in switching the pump 134 on to provide water to the condenser 114. In this sense the pump 134 can be controlled (used in the sense of 'controlling' as described above in the other embodiments) based upon temperature. The pump 134 can be regulated in speed and state (e.g. on v. off), to set forth just a few examples. In one form the temperature related to operation of the condenser 114 can be an outlet flow temperature of refrigerant from the condenser, such as that shown in the illustrated embodiment. Other locations are also contemplated. The embodiment described in FIG. 4 can be used under variable load conditions. In one form the embodiment can provide consistent condenser temperatures under variable load conditions.

Unless indicated to the contrary, like reference numerals refer to like elements between the different embodiments. For example, compressor 102 and its variations discussed above with respect to any given embodiment apply across all embodiments of the compressor 102. Thus, variations of the compressor 102 mentioned in FIG. 1 also apply to the embodiments of FIG. 2, and vice versa. No limitation is intended to limit variations of the compressor 102 mentioned above with respect to FIG. 1 to only apply to the embodiments of the compressor system 100 discussed with respect to FIG. 1, unless explicitly indicated to the contrary. The same applies to any other reference numeral/element pairing found throughout the instant application.

One aspect of the present application an apparatus comprising a gas compressor system having a compressor structured to rotate a mechanical compression member and produce a stream of compressed wet gas, the gas compressor system having a refrigerated dryer configured to dry the wet compressed gas by removing condensable vapor, the refrigerated dryer including a dryer compressor to compress a refrigeration fluid, a condenser to receive compressed refrigerated fluid, and an evaporator to exchange heat between the wet compressed gas and the refrigeration fluid, the gas compressor system including an expansion tank to receive an inflow of a condensate produced from the condensable vapor as a result of operation of the evaporator, the expansion tank having an outlet in fluid communication with a valving member having a first inflow passage to receive condensate from the expansion tank and water from a utility water supply, wherein the valving member is configured to flow one or both of the condensate and water to a condenser pump which provides one or both of the condensate and water to the condenser.

A feature of the present application includes wherein a check valve is disposed intermediate with and in fluid communication with both the expansion tank and the valving member.

Another feature of the present application includes wherein the check valve is oriented to permit flow from the expansion tank to the valving member, but to check a flow from the valving member to the expansion tank.

Still another feature of the present application includes wherein the valving member operates based upon a Venturi effect in which a flow of water from the utility water supply is a primary flow used to entrain water from the expansion tank, wherein water from the expansion tank is a secondary flow of the valving member.

Yet another feature of the present application includes wherein the compressor system further includes a high water level sensor to detect a water level in the tank that represents a volumetric fill quantity greater than half the fill quantity of the expansion tank.

Still yet another feature of the present application includes wherein the high water level sensor is used to detect a high water level within the expansion tank, and which further includes an overflow valve operable to open and vent excess water from the expansion tank when the high water level sensor detects a high water level.

Yet still another feature of the present application further includes a high water level sensor, a low water level sensor, and an overflow valve, wherein the overflow valve is actuated to an open position to vent water from the expansion tank when the high water level sensor detects a high water level, wherein the valving member is actuated to provide water from the utility water supply to the condenser pump when the low water level sensor detects a low water level.

A further feature of the present application includes wherein the valving member is a controllable valve that includes a movable member structured to move between a first position in which water from the utility water supply is used to supply water to the pump and a second position in which water from the expansion tank is used to supply water to the pump, and wherein the valving member can include an intermediate position between the first and second position in which a mixture of water from the expansion tank and the utility water supply are used to supply liquid to the pump Another aspect of the present application includes an apparatus comprising a gas compressor system structured to compress a fluid stream that includes air and water vapor to create a compressed mixed gas stream, the gas compressor system including a refrigerated dryer configured to cool the compressed mixed gas stream and remove the water vapor by condensing the water vapor through cooling action of an evaporator of the refrigerated dryer thus forming a condensate water produced from the water vapor and which is routed to an expansion tank, the refrigerated dryer also including a condenser structured to receive and cool a refrigeration fluid before providing the refrigeration fluid to the evaporator, the expansion tank having an outlet in fluid communication with a valving member and pump, the valving member also in fluid communication with a utility water supply and structured to flow one or both of condensate water from the expansion tank and water from the utility water supply to the pump, the pump providing liquid to the condenser of the refrigerated dryer.

A feature of the present application includes wherein the valving member is of a Venturi type that includes internal passages that provide a relatively low pressure and high speed flow of water from the utility water supply, and a relatively high pressure and low speed flow of condensate water from the expansion tank, the water from the utility water forming a primary flow that entrains a secondary flow in the form of the condensate water from the expansion tank.

Another feature of the present application further includes a check valve disposed between the expansion tank and the valving member, the check valve structured to permit flow of condensate water from the expansion tank to the valving member and discourage flow of water from the valving member to the expansion tank.

Still another feature of the present application includes wherein the compressor system further includes a high water level sensor configured to detect a high water level within the expansion tank.

Yet another feature of the present application further includes an overflow valve actuated by a command triggered by a high water level sensed by the high water level sensor.

Still yet another feature of the present application further includes a high water level sensor, a low water level sensor, and an overflow valve, wherein the overflow valve is actuated as a result of the high water level sensor detecting a high water level, and wherein the valving member is actuated to switch from using condensate water from the expansion tank to using water from the utility water supply when the low water level sensor detects a low water level in the expansion tank.

Yet still another feature of the present application includes wherein the valving member an select an intermediate position to provide liquid to the pump that includes a portion of condensate water from the expansion tank and water from the utility water supply.

Still another aspect of the present application includes a method comprising compressing air to create a wet compressed fluid stream, and drying the wet compressed fluid stream to form a condensate and relatively dry air, routing the condensate to an expansion tank, routing water from a utility water supply to a valving member, the valving member also in fluid communication with the expansion tank, and flowing one or both of the water and condensate to a condenser of a refrigerated dryer, the refrigerated dryer used to dry the wet compressed fluid stream.

A feature of the present application further includes mixing the water and condensate with the valving member.

Another feature of the present application includes wherein the mixing includes entraining a flow of condensate using a flow of water from the utility water supply.

Still another feature of the present application further includes venting condensate from the expansion tank when a high water level sensor detects a high water level in the expansion tank.

Yet still another feature of the present application further includes actuating the valving member to flow water from the utility water supply as a result of a low water level sensor detecting a low water level.

Still yet another feature of the present application further includes venting excess condensate from the expansion tank when a high water level sensor detects a high water level in the expansion tank.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. An apparatus comprising:

a gas compressor system having a compressor structured to rotate a mechanical compression member and produce a stream of compressed wet gas, the gas compressor system having a refrigerated dryer configured to dry the wet compressed gas by removing condensable vapor, the refrigerated dryer including a dryer compressor to compress a refrigeration fluid, a condenser to receive compressed refrigeration fluid, and an evaporator to exchange heat between the wet compressed gas and the refrigeration fluid, the gas compressor system including an expansion tank to receive an inflow of a condensate produced from the condensable vapor as a result of operation of the evaporator, the expansion tank having an outlet in fluid communication with a valving member having a first inflow passage to receive condensate from the expansion tank and a second inflow passage to receive water from a utility water supply, wherein the valving member is configured to flow one or both of the condensate and water to a condenser pump which provides one or both of the condensate and water to the condenser.

2. The apparatus of claim 1, wherein a check valve is disposed intermediate with and in fluid communication with both the expansion tank and the valving member.

3. The apparatus of claim 2, wherein the check valve is oriented to permit flow from the expansion tank to the valving member, but to check a flow from the valving member to the expansion tank.

4. The apparatus of claim 3, wherein the valving member operates based upon a Venturi effect in which a flow of water from the utility water supply is a primary flow used to entrain water from the expansion tank, wherein water from the expansion tank is a secondary flow of the valving member.

5. The apparatus of claim 4, wherein the compressor system further includes a high water level sensor to detect a water level in the tank that represents a volumetric fill quantity greater than half the fill quantity of the expansion tank.

6. The apparatus of claim 5, wherein the high water level sensor is used to detect a high water level within the expansion tank, and which further includes an overflow valve operable to open and vent excess water from the expansion tank when the high water level sensor detects a high water level.

7. The apparatus of claim 1, which further includes a high water level sensor, a low water level sensor, and an overflow valve, wherein the overflow valve is actuated to an open position to vent water from the expansion tank when the high water level sensor detects a high water level, wherein the valving member is actuated to provide water from the utility water supply to the condenser pump when the low water level sensor detects a low water level.

8. The apparatus of claim 7, wherein the valving member is a controllable valve that includes a movable member structured to move between a first position in which water from the utility water supply is used to supply water to the pump and a second position in which water from the expansion tank is used to supply water to the pump, and wherein the valving member can include an intermediate position between the first and second position in which a mixture of water from the expansion tank and the utility water supply are used to supply liquid to the pump.

9. An apparatus comprising:

a gas compressor system structured to compress a fluid stream that includes air and water vapor to create a compressed mixed gas stream, the gas compressor system including a refrigerated dryer configured to cool the compressed mixed gas stream and remove the water vapor by condensing the water vapor through cooling action of an evaporator of the refrigerated dryer thus forming a condensate water produced from the water vapor and which is routed to an expansion tank, the refrigerated dryer also including a condenser structured to receive and cool a refrigeration fluid before providing the refrigeration fluid to the evaporator, the expansion tank having an outlet in fluid communication with a valving member and pump, the valving member also in fluid communication with a utility water supply and structured to flow one or both of condensate water from the expansion tank and water from the utility water supply to the pump, the pump providing liquid to the condenser of the refrigerated dryer.

10. The apparatus of claim 9, wherein the valving member is of a Venturi type that includes internal passages that provide a relatively low pressure and high speed flow of water from the utility water supply, and a relatively high pressure and low speed flow of condensate water from the expansion tank, the water from the utility water forming a primary flow that entrains a secondary flow in the form of the condensate water from the expansion tank.

11. The apparatus of claim 10, which further includes a check valve disposed between the expansion tank and the valving member, the check valve structured to permit flow of condensate water from the expansion tank to the valving member and discourage flow of water from the valving member to the expansion tank.

12. The apparatus of claim 11, wherein the compressor system further includes a high water level sensor configured to detect a high water level within the expansion tank.

13. The apparatus of claim 12, which further includes an overflow valve actuated by a command triggered by a high water level sensed by the high water level sensor.

14. The apparatus of claim 9, which further includes a high water level sensor, a low water level sensor, and an overflow valve, wherein the overflow valve is actuated as a result of the high water level sensor detecting a high water level, and wherein the valving member is actuated to switch from using condensate water from the expansion tank to using water from the utility water supply when the low water level sensor detects a low water level in the expansion tank.

15. The apparatus of claim 14, wherein the valving member is capable of selecting an intermediate position to provide liquid to the pump that includes a portion of condensate water from the expansion tank and water from the utility water supply.

16. A method comprising:

compressing air to create a wet compressed fluid stream; and drying the wet compressed fluid stream to form a condensate and relatively dry air;

routing the condensate to an expansion tank;

routing water from a utility water supply to a valving member, the valving member also in fluid communication with the expansion tank to receive condensate from the expansion tank; and flowing one or both of the water and condensate to a condenser of a refrigerated dryer, the refrigerated dryer used to dry the wet compressed fluid stream.

17. The method of claim 16, which further includes mixing the water and condensate with the valving member.

18. The method of claim 17, wherein the mixing includes entraining a flow of condensate using a flow of water from the utility water supply.

19. The method of claim 18, which further includes venting condensate from the expansion tank when a high water level sensor detects a high water level in the expansion tank.

20. The method of claim 16, which further includes actuating the valving member to flow water from the utility water supply as a result of a low water level sensor detecting a low water level.

21. The method of claim 20, which further includes venting excess condensate from the expansion tank when a high water level sensor detects a high water level in the expansion tank.

* * * * *